US005643068A

United States Patent [19]

Ward, Sr.

[11] Patent Number: 5,643,068

[45] Date of Patent: Jul. 1, 1997

[54] ABRADING WHEEL HAVING INDIVIDUAL SHEET MEMBERS

[75] Inventor: Robert E. Ward, Sr., St. Paul, Minn.

[73] Assignee: Minnesota Mining and Manufacturing Company, St. Paul, Minn.

[21] Appl. No.: 450,158

[22] Filed: May 26, 1995

Related U.S. Application Data

[62] Division of Ser. No. 335,598, Nov. 8, 1994, abandoned, which is a continuation of Ser. No. 127,336, Sep. 27, 1993, abandoned.

[51] Int. Cl.[6] ..... B24D 18/00

[52] U.S. Cl. ..... 451/526; 451/539; 51/293

[58] Field of Search ..... 51/293, 297; 451/526, 451/533, 537, 539, 510, 466, 465, 463, 921, 527, 529–532, 534–536, 538, 464, 544

[56] References Cited

U.S. PATENT DOCUMENTS

| | | | |
|---|---|---|---|
| 267,735 | 11/1882 | Whittemore | 15/230.12 |
| 269,688 | 12/1882 | Levett | 15/230.14 |
| 291,610 | 1/1884 | Levett | 15/230 |
| 3,081,584 | 3/1963 | Bullard | 51/209 |
| 3,148,963 | 9/1964 | DeNuke | 51/293 |
| 3,241,267 | 3/1966 | Block et al. | 51/336 |
| 3,267,623 | 8/1966 | Block | 51/406 |
| 3,385,010 | 5/1968 | Vorce et al. | 51/395 |
| 3,562,968 | 2/1971 | Johnson et al. | 51/389 |
| 3,653,858 | 4/1972 | Field | 51/378 |
| 3,849,949 | 11/1974 | Steinhauser et al. | 51/406 |
| 3,912,142 | 10/1975 | Steinhauser et al. | 225/52 |
| 3,959,935 | 6/1976 | Stoppacher | 51/395 |
| 4,294,357 | 10/1981 | Stevens et al. | 206/409 |
| 4,518,452 | 5/1985 | Hundebol | 156/211 |
| 4,689,922 | 9/1987 | Blanchard, Jr. | 51/358 |
| 4,893,438 | 1/1990 | Fry et al. | 51/394 |
| 4,903,440 | 2/1990 | Larson et al. | 51/298 |
| 5,055,113 | 10/1991 | Larson et al. | 51/298 |
| 5,119,601 | 6/1992 | Yamashita et al. | 51/334 |
| 5,123,216 | 6/1992 | Kloss et al. | 51/170 MT |
| 5,125,192 | 6/1992 | Welsch | 51/395 |
| 5,142,829 | 9/1992 | Germain | 51/405 |
| 5,183,479 | 2/1993 | Grimes | 51/293 |
| 5,197,998 | 3/1993 | Germain | 51/297 |

*Primary Examiner*—Robert A. Rose

*Attorney, Agent, or Firm*—Gary L. Griswold; Walter N. Kirn; James J. Trussell

[57] ABSTRACT

The invention relates to an abrasive sheet member produced from the interstitial sheet material between circular abrasive discs during converting operations. The sheet material includes at least three projecting ends separated from each other by a boundary having a radius of curvature with a center of curvature located outside the sheet member.

18 Claims, 4 Drawing Sheets

ABRADING WHEEL HAVING INDIVIDUAL SHEET MEMBERS

This is a division of application Ser. No. 08/335,598, filed Nov. 8, 1994 now abandoned, which is a continuation of Application Ser. No. 08/127,336 filed Sep. 27, 1993, now abandoned.

TECHNICAL FIELD

The invention relates to an abrading wheel including a plurality of individual sheet members that each have at least three projecting ends.

BACKGROUND OF THE INVENTION

Abrading wheels comprising one or more circular abrasive discs are often used to rotatively remove material from a surface. These circular discs are typically die cut from a larger sheet of abrasive material, which may comprise, for example, a backing and a plurality of abrasive grains bonded to the backing. An exemplary circular abrasive disc is available from the Minnesota Mining and Manufacturing Company of St. Paul, Minn. under the designation Three-M-ite™ Resin Bond Disc.

In the die cutting process used to produce circular abrasive discs, a plurality of circular dies are arranged to cut a like plurality of discs from the abrasive sheet member. The arrangement of the dies, and thus of the discs cut in the sheet, may be selected as desired. Two such arrangements are shown in FIGS. 1 and 2. The circular abrasive discs are cut from a larger sheet 12 by a die cutting apparatus, leaving a sheet member having a plurality of arranged openings. This operation is known as "converting," and it is desirable in the converting industry to minimize waste when converting large abrasive sheet members into smaller circular abrasive discs. However, some amount of waste is almost unavoidable when cutting circular discs from a rectangular sheet member. This waste, referred to herein as the interstitial sheet material 14, remains between adjacent circular discs after converting, and has heretofore been discarded. This interstitial sheet material can amount to a sizable percentage of the total area of the sheet material, and thus such converting operations can be wasteful and inefficient.

It is therefore desirable to minimize the waste that has previously been the product of abrasive disc converting operations.

SUMMARY OF THE INVENTION

The present invention includes an abrasive sheet member having at least three projecting ends, wherein each end is separated from each adjacent end by a boundary having a radius of curvature with a center of curvature located outside the sheet member. These abrasive sheet members may easily be cut from the larger abrasive sheet during converting operations, and thus reduce waste in converting. The sheet member may include, for example, three or more ends, a central aperture, and the respective radii of curvature may be equal to or different from each other.

In another embodiment, an abrading wheel is provided, comprising a plurality of sheet members, each sheet member having at least three projecting ends, each end separated from each adjacent end by a boundary having a radius of curvature with a center of curvature located outside the sheet member, each sheet member having a central aperture; means for fastening said sheet members together through said respective central apertures; and means for enabling engagement of the abrading wheel with a source of rotary power.

In another embodiment, a method is provided for forming an abrasive sheet member, comprising the steps of providing an abrasive sheet material; providing a cutting apparatus adapted to cut a sheet member, the sheet member having at least three projecting ends, each end separated from each adjacent end by a boundary having a radius of curvature with a center of curvature located outside the sheet member; and cutting a sheet member from the sheet material with the cutting apparatus. In another embodiment of the foregoing method, the method is adapted to cut a circular abrasive disc from the sheet material, and wherein the method further includes the step of cutting a circular abrasive disc from the sheet material coincident with the cutting of the sheet member.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
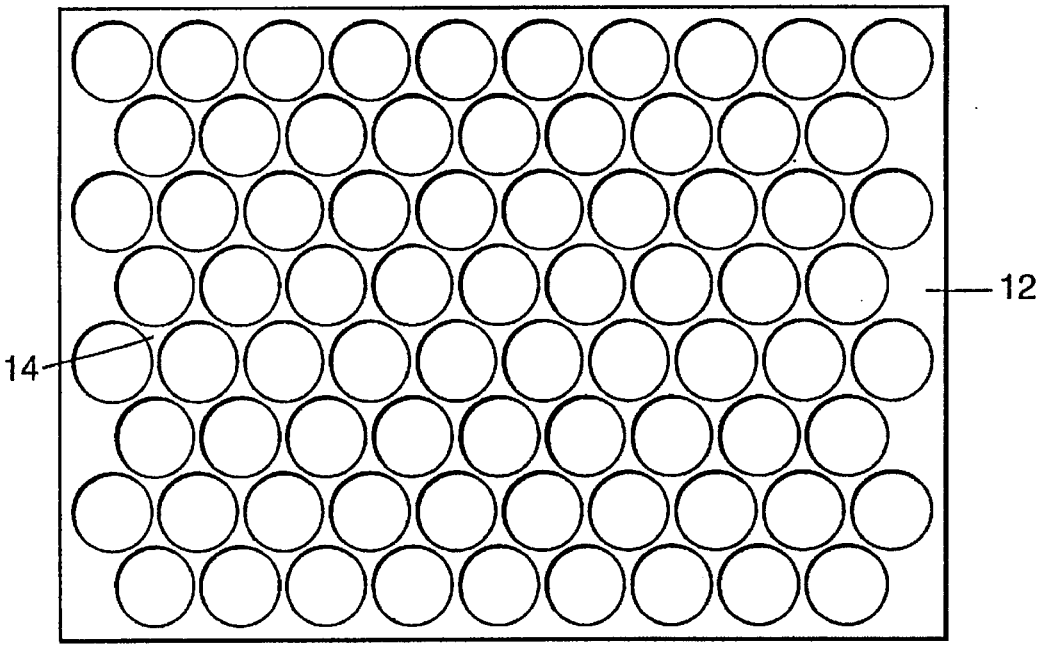
Fig. 1 PRIOR ART
FIGS. 1 and 2 are plan views of abrasive sheets in which a plurality of circular abrasive discs have been die cut.
Figure 2:
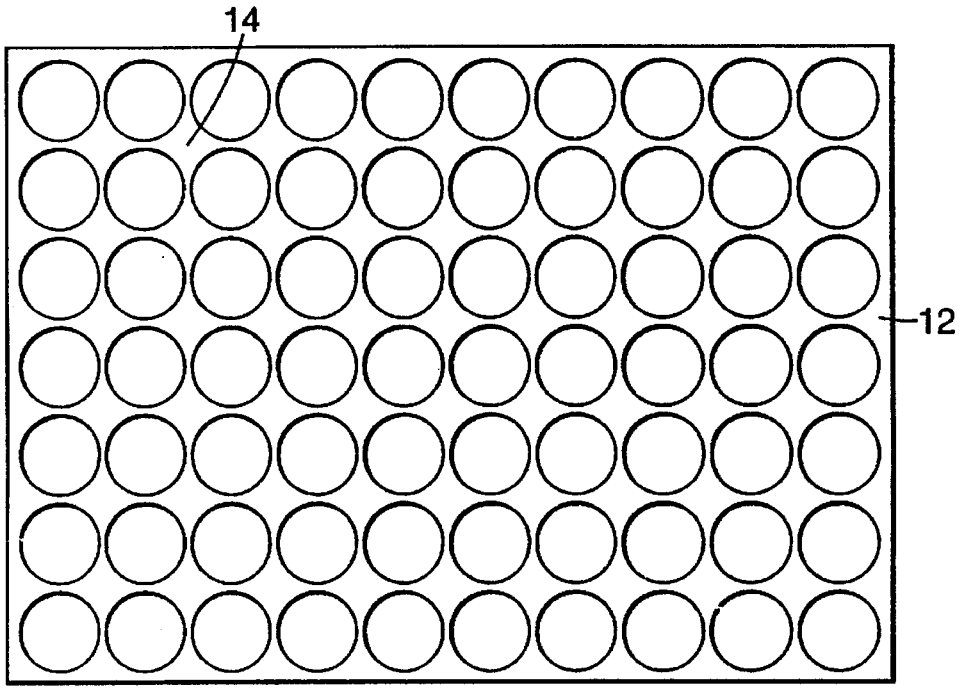
Fig. 2 PRIOR ART
Figure 3:
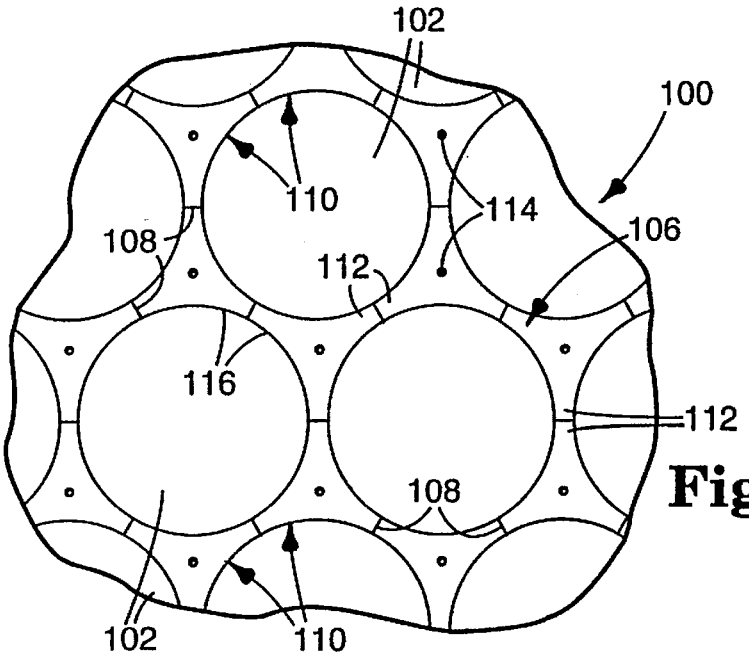
FIG. 3 is a plan view of an abrasive sheet in which a plurality of circular abrasive discs have been cut and removed, and in which a plurality of abrasive sheet members have been cut in accordance with the present invention.

The present invention reduces waste in abrasive disc converting operations by forming a useful article from the interstitial sheet material that has previously been discarded. A portion of an abrasive sheet member 100 is shown in FIG. 3, in which a plurality of circular abrasive discs have been cut and removed, leaving a like plurality of circular apertures 102. The abrasive sheet material typically comprises a substrate having abrasive grains bonded either into or onto the substrate. Examples of suitable abrasive sheet materials include coated abrasive sheets such as those disclosed in U.S. patent application Ser. No. 07/811,547U.S. Pat. No. 5,316,812, (Stout), entitled "Coated Abrasive Backing," the contents of which are incorporated by reference herein, and nonwoven abrasives such as those disclosed in U.S. Pat. No. 2,958,593 (Hoover et al.), entitled "Low Density Open Non-Woven Fibrous Abrasive Article," the contents of which are also incorporated by reference herein.

The interstitial sheet material 106 is die cut by a cutting apparatus, preferably at the same time as the circular abrasive discs are cut from the sheet. Specifically, dividing cuts 108 are formed, such that the interstitial sheet material 106 is divided into smaller sheet members 110 having, in the illustrated embodiment, three projecting ends 112 each having an end edge formed by dividing cuts 108. A central aperture 114 may also be provided in each sheet member, if desired, to facilitate attachment to a mandrel.

Figure 4:
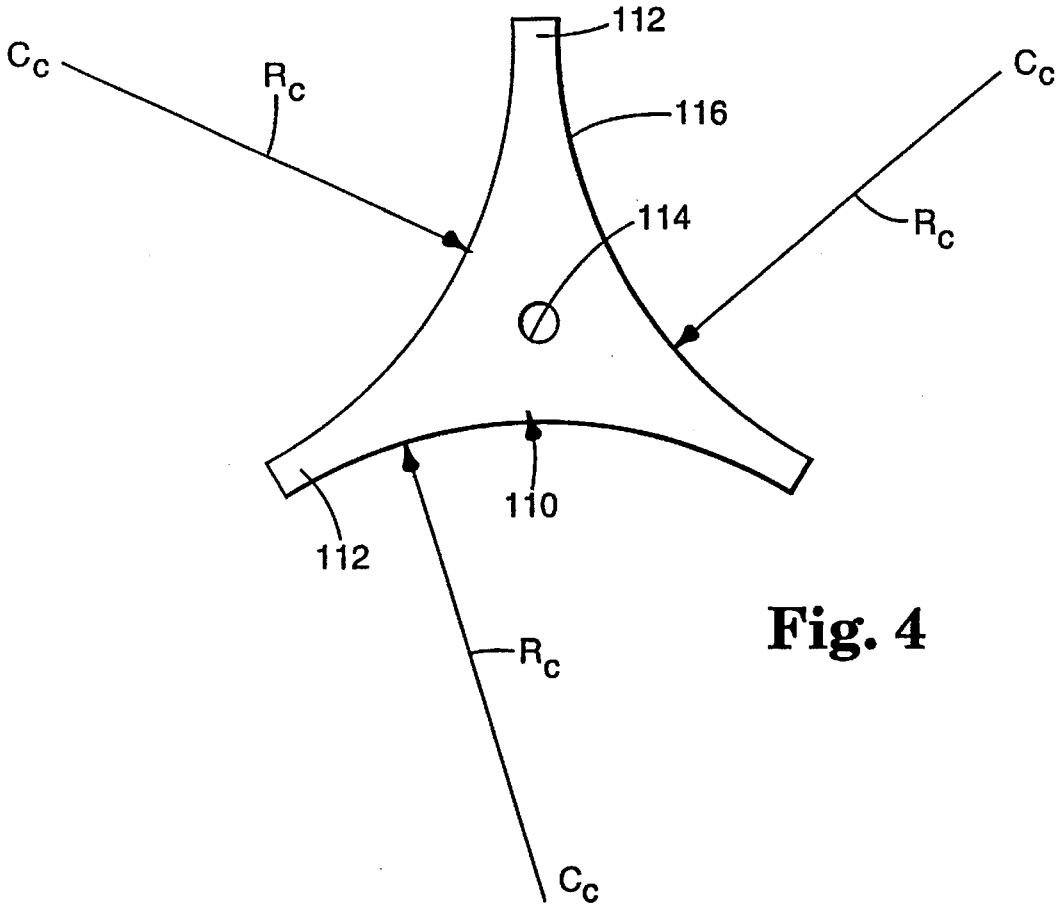
FIG. 4 is a plan view of a single abrasive sheet member having three projecting ends according to the present invention.

In the embodiment illustrated in FIG. 4, each sheet member 110 includes three projecting ends 112. Adjacent projecting ends 112 are connected to each other by a boundary 116. The major boundaries 116 are concave, meaning that each boundary has a radius of curvature $R_c$, and a center of curvature $C_c$ that is located outside the boundaries of the sheet member. In the preferred embodiment, the respective radii of curvature are equal, although other embodiments may include radii of curvature that are not equal. The shape of each projecting end 112 may be selected as desired, and may be, for example, pointed, although a flat or truncated end is preferred.

Figure 5A:
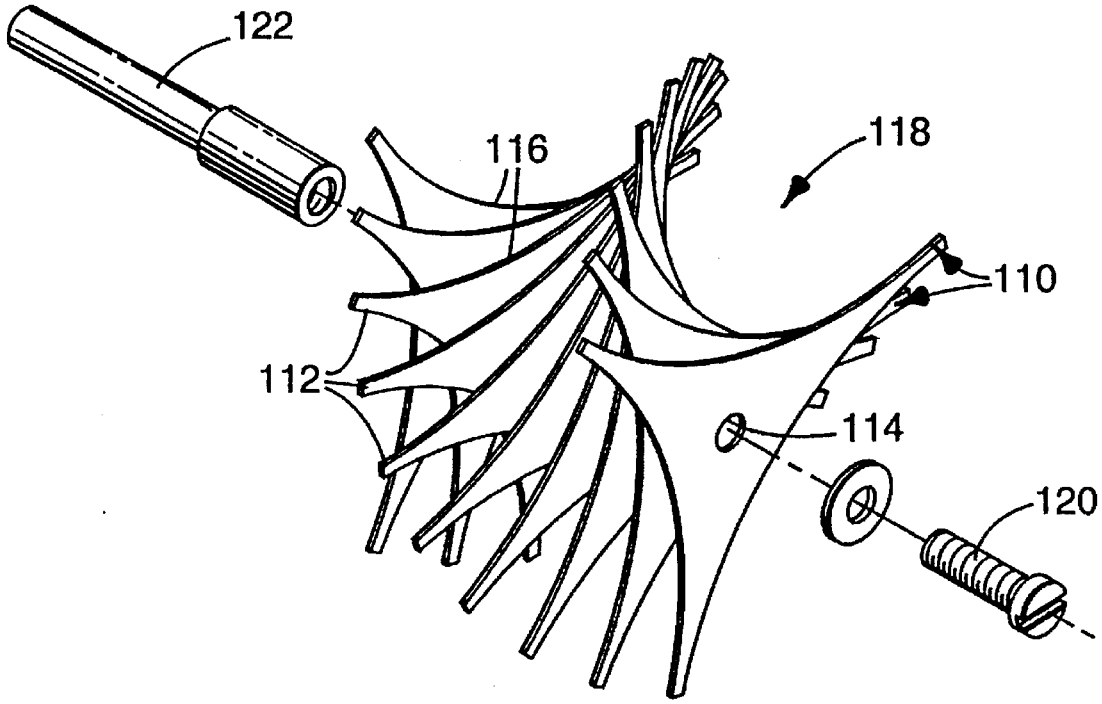
FIG. 5A is an exploded perspective view of a plurality of abrasive sheet members and a bolt and mandrel for forming the abrading wheel of the present invention.
Figure 5B:
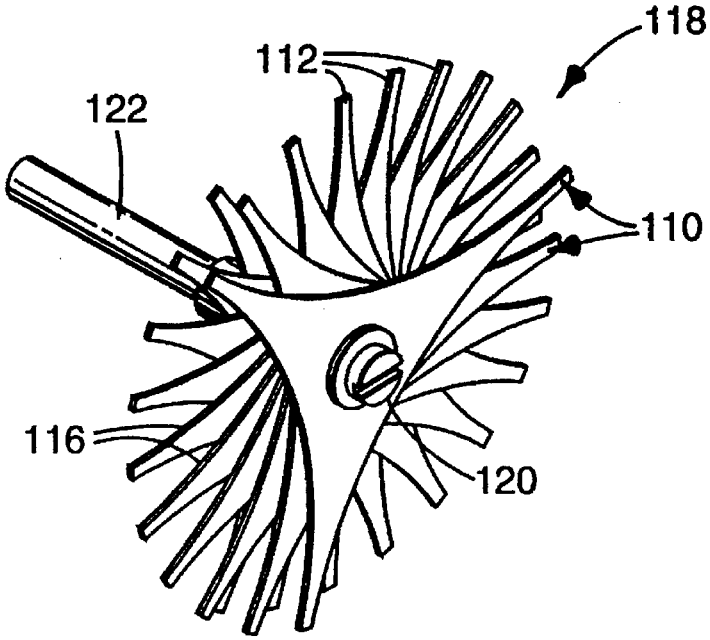
FIG. 5B is a perspective view of an assembled abrading wheel according to the present invention.

Several sheet members 110 may be detached from each other and assembled in the manner illustrated in FIG. 5A, to form an abrading wheel 118. Central apertures 114 are aligned and the sheet members 110 compressed, such that a bolt 120 may be passed through the apertures to retain the sheet members 110 with respect to a mandrel 122. Bolt 120 and mandrel 122 may be replaced with other retaining means, including but not limited to a rivet. One embodiment of an assembled abrading wheel 118 is shown in FIG. 5B. The retaining means may be operatively connected to a source of rotary power, to enable the abrading wheel 118 to abrade a workpiece. The number, size, and relative position of the sheet members 110 may be selected as desired, to optimize the abrading characteristics of a particular abrading wheel, for example.

Figure 6:
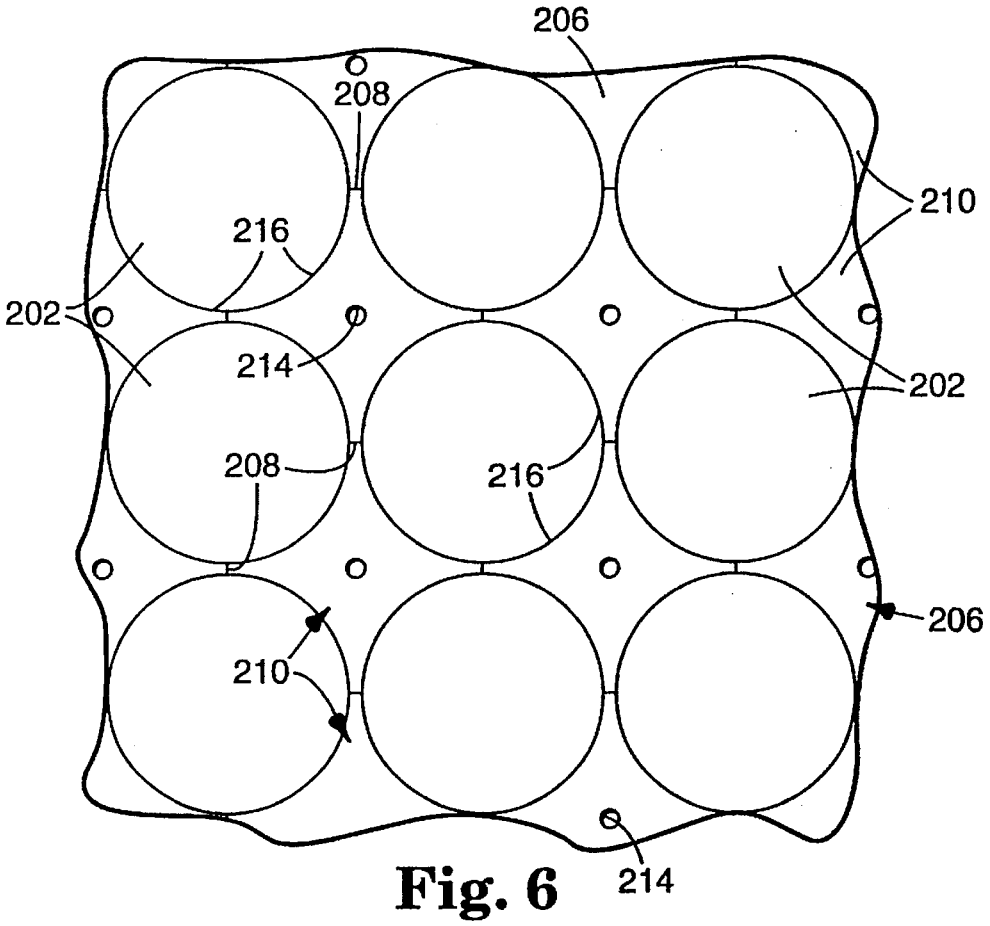
FIG. 6 is a plan view of an abrasive sheet in which a plurality of circular abrasive discs have been cut and removed, and in which a plurality of abrasive sheet members have been cut in accordance with a second embodiment of the present invention.

Sheet members having more than three projecting ends are also contemplated. For example, FIG. 6 illustrates a sheet of abrasive material having a plurality of circular apertures 202 formed therein when the abrasive discs are cut and removed. The interstitial sheet material 206 is also die cut by the cutting apparatus, preferably at the same time as the circular abrasive discs. Dividing cuts 208 are formed, such that the interstitial sheet material 206 is divided into smaller sheet members 210 having four projecting ends each having an end edge formed by dividing cuts 208. The major boundaries 216 are concave, as described with regard to the embodiment shown in FIG. 4, and a central aperture 214 has been formed in each sheet member. The sheet members may be assembled to form an abrading wheel as generally shown in FIGS. 5A and 5B with reference to the preceding embodiment.

Figure 7:
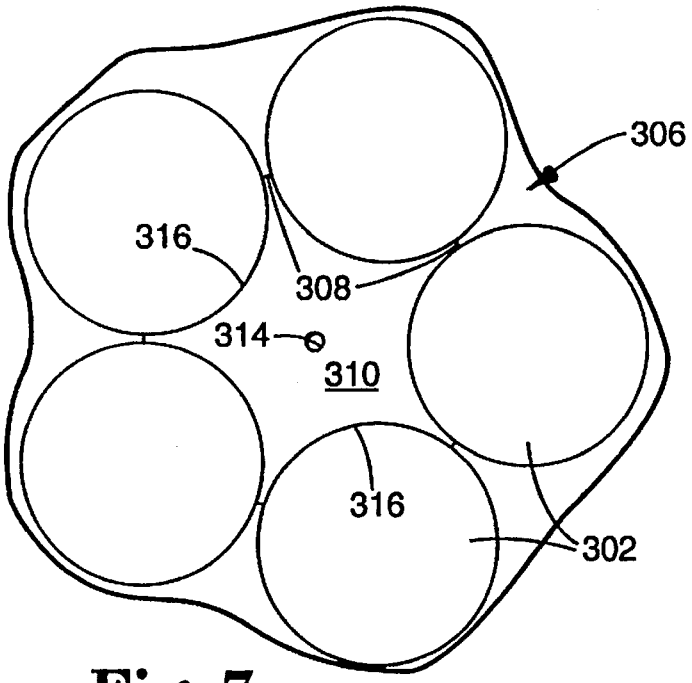
FIG. 7 is a plan view of an abrasive sheet in which a plurality of circular abrasive discs have been cut and removed, and in which an abrasive sheet member has been cut in accordance with a third embodiment of the present invention.

FIG. 7 illustrates yet another embodiment, including a sheet of abrasive material having a plurality of circular apertures 302 formed therein due to the cutting and removal of the circular abrasive discs. The interstitial sheet material 306 is also die cut by the cutting apparatus, preferably at the same time as the circular abrasive discs. Dividing cuts 308 are formed, such that the interstitial sheet material 306 is divided into smaller sheet members 310 having five projecting ends each having an end edge formed by dividing cuts 308. Boundaries 316 are concave, as described with regard to the embodiment shown in FIG. 4, and a central aperture 314 has been formed in the sheet member to facilitate attachment of a plurality of sheet members to a retaining means. The sheet members may be assembled to form an abrading wheel as generally shown in FIGS. 5A and 5B.

The abrading wheel of the present invention may be particularly useful for abrading, or deburring, a cylindrical hole or passageway. For example, the abrading wheel may be attached to a source of rotary power, and used to abrade the interior of a pipe, tube, hollow shaft, or a hole bored in a workpiece. For these applications, it may be beneficial to urge the rotating abrading wheel completely through the length of the passageway, and then to withdraw the rotating abrading wheel from the length of the passageway. Because of the abrasive material on two opposite faces of the abrading wheel, this process results in the passageway being abraded in two directions. The foregoing is intended to be a nonlimiting example, and other applications are intended to be within the scope of the present invention.

The size of the abrading wheel (and therefore the size of the abrasive sheet members used to construct the wheel) may be chosen as desired. For applications such as abrading a cylindrical passageway, it may be desirable to provide an abrading wheel of greater diameter than the passageway, to insure that the abrading wheel is in constant contact with the wall of the passageway.

The following Example illustrates the construction of the present invention.

EXAMPLE

An abrasive sheet material was provided in roll form to a die cutting apparatus. The sheet material was grade 180 Three-M-ite™ Resin Bond Cloth, X weight, Type FR. This sheet material is a medium grade abrasive on an X weight (225 g/m$^2$ (6.5 oz/yd$^2$)) cloth. It should be noted that samples cut from J weight (174 g/m$^2$ (5.0 oz/yd$^2$)) cloth also were constructed and tested as described below, and also performed acceptably.

The roll of abrasive sheet material was provided to a single cut impact press of the type available from USM Hydraulic Machinery, Inc., of Beverly, Mass. under model number B2. The impact press included a die, which was adapted to cut an abrasive sheet member such as that shown in FIG. 4. The radius of curvature was approximately 7.62 cm (3.0 in), and the width of each of the projecting ends was approximately 0.60 cm (0.236 in). Each die also included surfaces adapted to die cut a circular aperture in the center of each three cornered abrasive sheet member, wherein the central aperture measured 0.635 cm (0.25 in) in diameter. The abrasive sheet material was placed with the abrasive side facing away from the cutting surfaces of the die, and a three cornered abrasive sheet member was cut from the sheet material. In like manner, eleven additional three cornered abrasive sheet members were die cut from the sheet material, to provide a total of twelve abrasive sheet members.

Six of the three cornered abrasive sheet members were then collected, and arranged with the abrasive face of each sheet member facing in the same direction as each adjacent sheet member. The abrasive sheet members were aligned about their respective central apertures, and were fanned out (as shown in FIG. 5A), so that the projecting ends of each sheet member were evenly spaced from each adjacent projecting end. The other six three cornered abrasive sheet members were similarly arranged, and the two groups of six sheet members were then abutted, so that the abrasive faces of one group of abrasive sheet members faced away from the abrasive faces of the other group of abrasive sheet members. The abrasive sheet members were then retained using a bolt and mandrel arrangement such as that shown in FIG. 5A. This arrangement allowed an abrasive surface to be exposed on each side of the assembled abrading wheel, which is thought to be useful for applications such as cleaning or abrading the interior of, for example, a cylindrical pipe. The abrading wheel so prepared was tested, and found to be satisfactory.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

I claim:

1. A method of forming an abrasive sheet member, comprising the steps of:

a) providing an abrasive sheet material;

b) providing a cutting apparatus adapted to cut an abrasive sheet member, the abrasive sheet member having at least three projecting ends each projecting end including a respective end edge, wherein each of the end edges comprises a straight line, wherein each projecting end tapers to a narrowest width at the end edge, wherein each projecting end is separated from each adjacent projecting end by a boundary having a radius of curvature with a center of curvature located outside the sheet member, and wherein the radius of curvature of at least one of the boundaries is greater than a radius of a circle intersecting a point on each boundary; and c) cutting an abrasive sheet member from the sheet material with the cutting apparatus.

2. The method of claim 1, wherein the cutting apparatus is also adapted to cut a circular abrasive disc from the sheet material, and wherein the method further includes the step of:

d) cutting a circular abrasive disc from the sheet material.

3. The abrasive sheet member provided by the method of claim 1.

4. The method of claim 2, wherein the radius of curvature for each of the boundaries of the abrasive sheet member is equal and constant.

5. The method of claim 4, wherein the radius of the circular abrasive disc is equal to the radius of curvature of each of the boundaries of the abrasive sheet member.

6. The method of claim 5, wherein the circular abrasive disc has an outer periphery, and wherein a portion of a first one of the boundaries is formed by cutting the outer periphery of the circular disc.

7. A method for forming a plurality of abrasive sheet members, comprising the steps of:

a) forming a plurality of holes in a continuous abrasive sheet to thereby form an interstitial sheet; and b) separating the interstitial sheet into a plurality of abrasive sheet members;

wherein each of the abrasive sheet members comprises a plurality of projecting ends, each projecting end including a respective end edge, wherein each of the end edges comprises a straight line, and wherein each projecting end is separated from each adjacent projecting end by a boundary having a radius of curvature with a center of curvature located outside the abrasive sheet member.

8. A method for forming first and second abrasive sheet members from a continuous abrasive sheet, comprising the steps of:

a) cutting a plurality of first abrasive sheet members from a continuous abrasive sheet, wherein each of the first abrasive sheet members comprises a circular abrasive disc having an outer periphery; and b) cutting a plurality of second abrasive sheet members from that portion of the continuous abrasive sheet not comprising the plurality of first abrasive sheets, wherein each of the second abrasive sheet members comprises an interstitial abrasive sheet member comprising a plurality of projecting ends, each projecting end including a respective end edge, wherein each of the end edges comprises a straight line, and wherein each projecting end is separated from each adjacent projecting end by a boundary having a radius of curvature with a center of curvature located outside the interstitial abrasive sheet member.

9. The method of claim 7, wherein steps a) and b) are performed concurrently.

10. The method of claim 7, wherein step a) comprises forming a plurality of circular holes and wherein each circular hole includes a periphery.

11. The method of claim 10 wherein at least a portion of a first boundary of a first one of the plurality of abrasive sheet members is formed by a portion of the periphery of a first one of the plurality of circular holes.

12. The method of claim 11, wherein the entire first boundary is formed by a portion of the periphery of the first circular hole.

13. The method of claim 10, wherein step a) comprises forming a plurality of like-sized circular holes.

14. The method of claim 7, wherein step b) comprises forming an end edge at the outermost portion of each projecting end.

15. The method of claim 14, wherein each projecting end tapers to a narrowest width at the end edge.

16. The method of claim 11, wherein at least a portion the first boundary of a second one of the abrasive sheet members is formed by a portion of the periphery of the first circular hole.

17. The method of claim 8, wherein at least a portion of a first boundary of each of the interstitial abrasive sheet members is formed by cutting the outer periphery of a respective one of the circular abrasive discs.

18. The method of claim 17, wherein the first boundary of each of the plurality of interstitial abrasive sheet members is coextensive with the outer periphery of a respective one of the circular discs.

* * * * *